US007637754B1

(12) United States Patent
Yerena et al.

(10) Patent No.: US 7,637,754 B1
(45) Date of Patent: Dec. 29, 2009

(54) GROUND CONNECTOR FOR ATTACHMENT TO MULTIPLE SURFACES

(76) Inventors: Jesus Rodolfo Elizondo Yerena, 4348 Tantallon La., Apt. 306, Memphis, TN (US) 38125; Jerry Woodward, 2381 Logwood Briar Cove N., Collierville, TN (US) 38017

( * ) Notice: Subject to any disclaimer, the term of this patent is extended or adjusted under 35 U.S.C. 154(b) by 0 days.

(21) Appl. No.: 12/247,373

(22) Filed: Oct. 8, 2008

(51) Int. Cl.
*H01R 4/66* (2006.01)

(52) U.S. Cl. ..... 439/108

(58) Field of Classification Search ..... 439/100, 439/101, 102, 108, 798, 803, 804; 248/70, 248/72; 174/51
See application file for complete search history.

(56) References Cited

U.S. PATENT DOCUMENTS

| | | | | |
|---|---|---|---|---|
| 1,986,028 | A | 1/1935 | Terry | |
| 2,029,149 | A | 1/1936 | Barnes | |
| 2,701,351 | A | 2/1955 | Weber | |
| 3,133,779 | A * | 5/1964 | Stanback | 439/798 |
| 3,901,577 | A * | 8/1975 | Philibert et al. | 439/804 |
| 4,320,882 | A * | 3/1982 | Bachle | 248/70 |
| 4,776,808 | A * | 10/1988 | Davidson | 439/100 |
| 5,044,584 | A | 9/1991 | Lin | |
| 5,281,761 | A | 1/1994 | Woo et al. | |
| 5,281,762 | A | 1/1994 | Long et al. | |
| 5,888,104 | A | 3/1999 | Mello et al. | |
| 6,252,166 | B1 | 6/2001 | Leschinger | |
| 6,561,473 | B1 | 5/2003 | Ianello | |
| 6,664,469 | B1 * | 12/2003 | Sweeney | 174/51 |

* cited by examiner

*Primary Examiner*—Chandrika Prasad

(57) ABSTRACT

An electrical ground connector provides attachment to a grounded member. The ground connector includes an elongate bus bar having a first planar surface including a plurality of conductor insertion apertures for accommodating the ends of the electrical conductors therein. A second planar surface generally parallel to the first planar surface includes a plurality of set screw apertures in communication with the conductor insertion apertures for accommodation of the set screw to the ends of the conductors to the bus bar. The bus bar includes a third surface for engagement with the grounded member. The bus bar defines a pair of longitudinally extending spaced apart feet for placement in electrical contacting relationship with the grounded member. The grounded member may be either a cylindrical member or a planar grounded member.

9 Claims, 2 Drawing Sheets

GROUND CONNECTOR FOR ATTACHMENT TO MULTIPLE SURFACES

FIELD OF THE INVENTION

The present invention relates generally to a ground connector for establishing ground continuity between electrical conductors and a grounded member. More particularly, the present invention relates to a ground connector which may be attached to various configurations of grounded members.

BACKGROUND OF THE INVENTION

Most electrical systems used in houses, buildings and other structures require an electrical connection between the electrical system and ground potential. Such systems may include electrical power, data and communications. Each system must be separately attached to a source of ground potential. Typically, the source of electrical ground potential is a pipe, panel or bar which is electrically fixed at ground potential. Many electrical codes require that all ground connections be made to a single element attached to common ground potential.

The art has seen a wide variety of ground connectors, such as bus bars, which may be attached to the source of ground potential and provide for connection of the ground conductors of the electrical system. In order to assure proper electrical continuity between the bus bar and the source of ground potential, the bus bars are typically configured to attach to a particular source of ground potential. For example, U.S. Pat. No. 6,252,166 shows a grounding bracket for attachment to a flat panel.

U.S. Pat. No. 5,281,761 shows a ground clamp for connection to a grounded pipe, such as a water pipe.

However, quite often, the electrical installer prior to arrival at the site does not necessarily know which type of device is going to be used to establish ground connection. Therefore, the installer must carry multiple grounding connectors in order to accommodate the on-site need. Moreover, each of these connectors must be sufficient size to accommodate multiple ground conductors to assure common ground of the electrical systems.

As may be appreciated, the need to provide multiple configurations of ground connectors results in supply, inventory and delivery delays.

It is, therefore, desirable to provide a universal ground connector which may be applied to a variety of grounded devices.

SUMMARY OF THE INVENTION

The present invention provides an electrical ground connector for attachment to a grounded member. The ground connector includes an elongate bus bar having a first planar surface including a plurality of conductor insertion apertures for accommodating the ends of an electrical conductor therein. A second planar surface, generally perpendicular to the first planar surface, includes a plurality of set screw apertures in communication with the conductor insertion apertures for accommodation of a set screw to secure the ends of the conductor in the bus bar in mechanical and electrical engagement. The bus bar includes a third surface for engagement with the grounded member where the bus bar defines a pair of longitudinally extending spaced apart feet for placement in electrical contacting relationship with the ground member.

The bus bar is designed so it can secure the conductors to a cylindrical pipe or to a flat panel.

DETAILED DESCRIPTION OF THE PREFERRED EMBODIMENTS

The present invention provides a ground connector which permits the ground connection of a plurality of conductors to a grounded member which preferably may either be a cylindrically shaped member or a flat panel.

Figure 1:
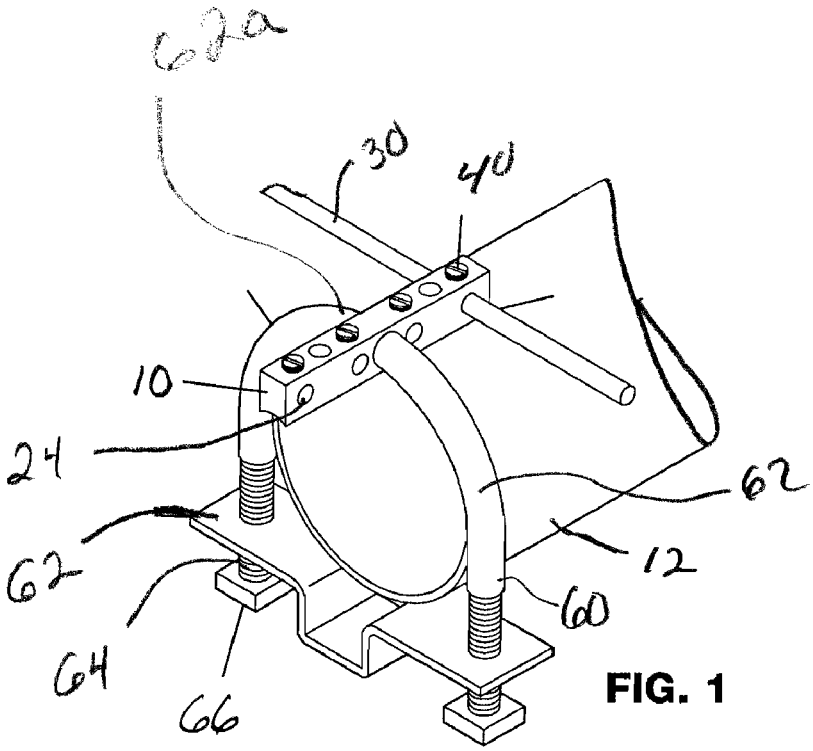
FIG. 1 is a perspective showing of one embodiment of the connector of the present invention shown connecting a conductor to a cylindrical pipe.
Figure 2:
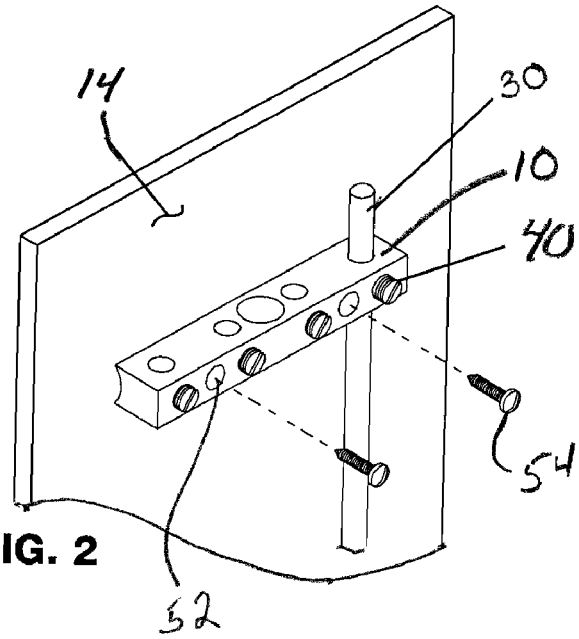
FIG. 2 shows the connector of FIG. 1 connecting a conductor to a planar panel.

Referring to FIGS. 1 and 2, the connector 10 of the present invention is shown attached to a grounded cylindrical member 12 and a grounded flat panel 14, shown respectively in FIGS. 1 and 2.

Figure 3:
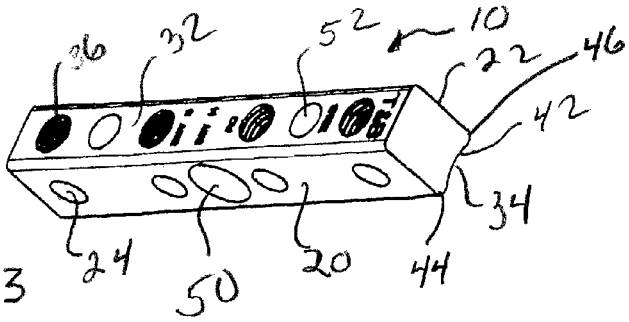
FIG. 3 is a perspective showing of the connector of FIGS. 1 and 2.

Referring additionally to FIG. 3, connector 10 is an elongate bus bar connector having a generally rectangular configuration and is formed of a suitable electrically conductive metal. In the present illustrative embodiment, connector 10 may be formed of copper, aluminum, stainless steel or any other metal which may effect electrical ground connection. The bus bar connecter 10 includes a pair of opposed generally parallel elongate planar surfaces 20 and 22. The bus bar connector 10 further includes a plurality of conductor receiving apertures 24 which extend through surfaces 20 and 22. The apertures 24 are configured so as to accommodate therein a ground conductor 30. As shown in FIG. 3, four conductor receiving apertures 24 are provided so as to accommodate four conductors in side-by-side parallel orientation. However, as may be appreciated, any number of conductor receiving apertures may be provided.

Bus bar connector 10 further includes a pair of opposed elongate surfaces 32 and 34 which are generally perpendicular to surfaces 20 and 22. Surface 32 includes a plurality of set screw receiving apertures 36 extending into the body of bus bar connector 10 aligned and in a one-to-one correspondence with conductor receiving apertures 24. Set screw receiving apertures 36 are in communication with conductor receiving apertures 24 and are designed to insertably accommodate set screws 40 so as to engage a conductor 30 inserted through aperture 24. As is known in the bus bar art, the set screws 40 may be used to positionally secure the conductors 30 within apertures 24.

Elongate surface 34 includes a generally arcuate central portion 42 which defines a pair of spaced apart elongate extending feet 44 and 46 on either side thereof, the purpose of which will be described in further detail hereinbelow.

Referring more specifically to FIGS. 1 and 3, the bus bar connector 10 of the present invention is shown being attached to a grounded cylindrical member 12. The grounded cylindrical member 12 may be a water pipe or other cylindrical member which is electrically grounded at ground potential so that ground connection may be made thereto.

The connector 10 further includes a central bore 50 extending through opposed surfaces 20 and 22 between apertures 24. The bore 50 is configured so as to accommodate a U-clamp assembly 60.

U-clamp assembly 60 includes a U-shaped rod-like member 62 having opposed threaded end extents 64. A clamp 66 may be adjustably attached to the extents 64 and secured thereto by nuts 66. The U-shaped member 62 is inserted through bore 50 such that it resides at the base 62*a* of the U-shaped member 62. Clamp assembly 60 may then be placed about the cylindrical member 12 and the clamp may be secured to the cylindrical 12 in mechanical and electrical engagement.

In the position shown in FIG. 1, spaced apart feet 42 and 44 stabilize and position the bus bar connector 10 on the cylindrical surface of the cylindrical member 12. The feet 42 and 44 also establish electrical ground continuity with grounded cylindrical member 12.

Referring now to FIGS. 2 and 3, bus bar connector 10 may be used in a manner where it is attached to a flat panel 14. The flat panel 14 may be a wall of an electrical enclosure where the enclosure itself is grounded. Bus bar connector 10 further includes a plurality of mounting apertures 52 which extend through spaced apart surfaces 32 and 34 thereof. In the present illustrative embodiment, two mounting apertures 52 are shown positioned between set screw apertures 36. The mounting apertures 52 are used to accommodate mounting screws 54 therethrough.

Mounting screws 54 may be any of a wide variety of fasteners such as a sheet metal screws which are inserted through the mounting aperture 52 from surface 32 and through surface 34 and into flat panel 14. Positioned as shown in FIG. 2, the feet 42 and 44 of bus bar connector 10 are positioned against the flat panel establishing electrical continuity therebetween. Thus, once the conductors 30 are inserted into the conductor receiving aperture 24 and fixed with set screw 40, grounded electrical connection is established between the ground conductor 30 and flat panel 14.

It may be appreciated that the bus bar connector 10 of the present invention provides a grounded connection device for affixing to both a cylindrical member and a flat panel. Thus, an installer attempting to affix the grounded conductor can use the bus bar connector 10 of the present invention to establish ground connection to a wide variety of grounded members. This eliminates the need for the installer to carry different ground connectors for different applications.

Figure 4:
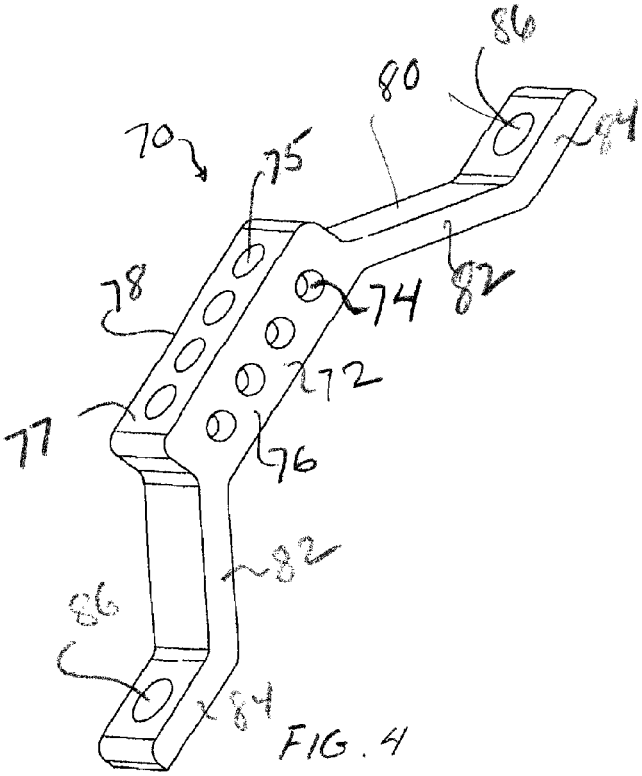
FIG. 4 is a perspective showing of a further embodiment of a bus bar connector of the present invention.

FIG. 4 shows a further embodiment of the ground connector of the present invention. Ground connector 70 is an elongate member which is formed of an electrically conductive metal such as copper, aluminum, stainless steel or any other metal which may effect electrical ground connection. Connector 70 has a central generally elongate rectangular bus bar body 72 having a plurality of conductor receiving apertures 74 extending through opposed planar surfaces 76 and 78. Set screw apertures 75 extend through an upper perpendicular planar surface 77 and are in communication with conductor receiving aperture 74. The bus bar body 72 functions in the same manner as bus bar connector 10 described above so as to accommodate ground conductors through aperture 74 in a manner where they are affixed therein by set screws inserted through set screw aperture 75.

Extending from each end of body 72 are lateral wings 80. Each lateral wings includes a depending arm 82 and an extending foot 84. The extending feet 84 are generally parallel to the body 72 of bus bar 70. The configuration of bus bar 70 thus provides a concavity defined by the bus bar body 72 and the depending arms 82. This concavity allows the connector 70 to be placed about a cylindrical member such as cylindrical member 12 shown in FIG. 10. The feet 84 include securement apertures 86 which are designed to accommodate the ends 64 of a U-clamp member 62 as shown in FIG. 1.

As with the embodiment of FIG. 1, the ends 64 of the U-clamp member 62 are screw threaded to accommodate nuts 66. Thus, the connector 70 of the present invention serves as the clamp for the U-shaped member so that the connector 70 may be affixed to a grounded cylindrical member.

In addition, the mounting apertures 86 may also be used to accommodate fastening hardware such as sheet metal screws so that the connector 60 may be attached to a grounded flat panel such as flat panel 14 shown in FIG. 2. In this embodiment, the feet 84 rests on the flat panel 14 and the screws may be inserted into apertures 86 to affix the connector 60 thereto. Thus, the connector 70, shown in FIG. 4, also provides the ability to affix the connector to both a grounded cylindrical member, such as cylindrical member 12 shown in FIG. 1, and grounded flat panel, such as flat panel 14 shown in FIG. 2.

Figure 5:
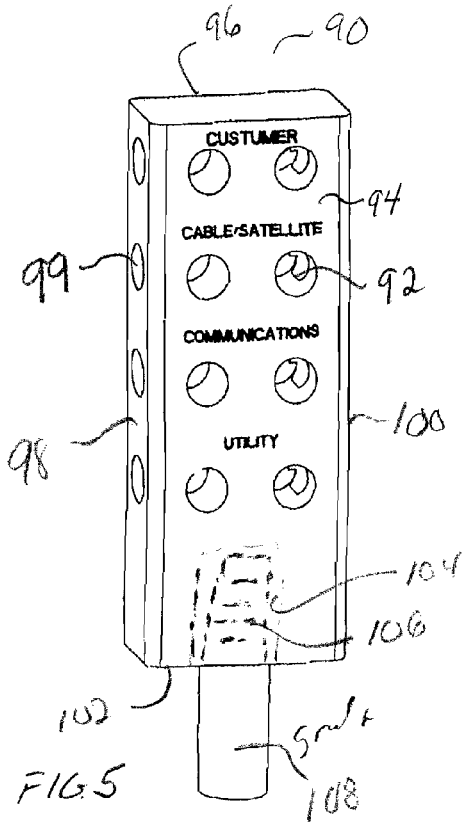
FIG. 5 is a still further embodiment of a bus bar connector of the present invention.

A still further embodiment of the present invention is shown in FIG. 5. This embodiment is used with a grounded rod. The connector 90 is generally a rectangular block formed of conductive metal having a plurality of conductor accommodating openings 92 extending through opposed major planar surfaces 94 and 96. In the present illustrative embodiment, the apertures 92 are arranged in two longitudinally extending rows. As shown in FIG. 5, the individual conductor receiving apertures 92 may be marked for a particular purpose. The screw apertures 99 extend from planar side surfaces 98 and 100 and are in communication with conductor receiving apertures 92.

The bottom planar surface 102 of connector 90 may include an internally threaded aperture 104 which threadedly accommodates the upper end 106 of ground rod 108. Thus, the connector 90 may be screw attached to the ground rod 108. The appropriate conductors may be inserted through conductor apertures 92 and secured therein by set screws (not shown) inserted through set screw apertures 99. As with the above embodiments, the connector 90 provides uniform ground attachment of the various types of ground conductors inserted therein.

Various changes to the foregoing described and shown structures would now be evident to those skilled in the art. Accordingly, the particularly disclosed scope of the invention is set forth in the following claims.

What is claimed is:

1. An electrical ground connector for attachment to a grounded member comprising:

an elongate bus bar having a first planar surface including a plurality of conductor insertion apertures for accommodating the ends of an electrical conductor therein, a second planar surface generally perpendicular to said first planar surface including a plurality of set screw apertures in communication with said conductor insertion apertures for accommodation of a set screw to secure said ends of said conductor to said bus bar in mechanical and electrical engagement;

said bus bar having a third surface for engagement with said grounded member and wherein said bus bar defines a pair of longitudinally extending spaced apart feet for placement in electrical contacting relationship with said grounded member.

2. An electrical ground connector of claim 1 wherein said third surface includes a longitudinal concave portion extending between said feet.

3. An electrical ground connector of claim 1 wherein said grounded member is cylindrical in shape and wherein said bus bar has a central aperture extending through said first planar surface for accommodating a U-clamp to secure said bus bar to said cylindrically shaped grounded member.

4. An electrical ground connector of claim 1 wherein said grounded member is planar in shape and wherein said bus bar includes at least one mounting aperture extending through said second surface for accommodating mounting hardware for securing said bus bar to said planar grounded member.

5. An electrical ground connector of claim 1 wherein said grounded member is alternately cylindrical and planar in shape;

wherein said bus bar has a central aperture extending through said first planar surface for accommodating a U-clamp to secure said bus bar to said cylindrically shaped ground member; and wherein said bus bar includes at least one mounting aperture extending through said second surface for accommodating mounting hardware for securing said bus bar to said planar shaped grounded member.

6. An electrical ground connector comprising:

an elongate conductive bus bar having a plurality of conductor receiving apertures extending therethrough, each conductor receiving aperture having a set screw receiving aperture in communication therewith for receiving a set screw for securing said conductors in said apertures;

said bus bar having a generally central aperture for accommodating a U-clamp for securing said bus bar to a cylindrically shaped grounded member; and said bus bar further including at least one mounting aperture for receiving mounting hardware for securing said bus bar to a grounded planar surface.

7. An electrical ground connector of claim 6 wherein said bus bar includes an elongate surface for engagement with said cylindrically shaped grounded member.

8. An electrical ground connector of claim 1 wherein said elongate surface is arcuate.

9. An electrical ground connector of claim 8 wherein said elongate arcuate surface defines a pair of spaced apart elongate feet.

* * * * *